United States Patent [19]

Riley

[11] 4,161,047

[45] Jul. 17, 1979

[54] PROCESS FOR RECOVERY OF HYDROCARBONS

[76] Inventor: Edwin A. Riley, 901 Ridgeway Ter., Arlington, Tex. 76012

[21] Appl. No.: 843,567

[22] Filed: Oct. 19, 1977

[51] Int. Cl.[2] ..... E21B 43/16; E21B 43/18

[52] U.S. Cl. ..... 166/266; 166/268

[58] Field of Search ..... 166/266, 265, 267, 245, 166/268, 252, 305 D; 405/55, 59

[56] References Cited

U.S. PATENT DOCUMENTS

| | | | |
|---|---|---|---|
| 1,198,078 | 9/1916 | Squires | 166/245 X |
| 1,735,646 | 11/1929 | Lewis | 166/266 |
| 2,135,319 | 11/1938 | Bays | 166/266 |
| 2,174,336 | 9/1939 | Walker et al. | 166/266 |
| 2,342,165 | 2/1944 | Plummer | 166/266 X |
| 2,355,588 | 8/1944 | Brandt | 166/266 X |
| 2,798,556 | 7/1957 | Binder, Jr. et al. | 166/245 |
| 3,123,134 | 3/1964 | Kyte et al. | 166/268 X |
| 3,149,668 | 9/1964 | Arendt | 166/266 |
| 3,274,101 | 9/1966 | West et al. | 166/266 X |

OTHER PUBLICATIONS

Muskat, Morris, *Physical Principles of Oil Production,* First Edition 1949, McGraw-Hill Book Co., Inc., N.Y., N.Y., pp. 376, 377, 483, 486, 490 and 491.

Morrow, "Updip Oil Recovery by Downdip Gas Injection", *The Petroleum Engineer,* 4-1957, vol. 29, No. 4, pp. B-28 to B-32.

*Primary Examiner*—Stephen J. Novosad

*Attorney, Agent, or Firm*—Pravel, Gambrell, Hewitt, Kirk, Kimball & Dodge

[57] ABSTRACT

A process for the recovery of hydrocarbons from oil field reservoirs, wherein dry pipeline quality natural gas, essentially entirely methane, is injected, stored and recycled in the wells of the reservoir to effect a significant recovery of the oil in the reservoir while storing and holding the gas for ultimate use only after the oil has been recovered from the reservoir, whereby the relatively scarce gas is utilized to its maximum extent and oil is produced which would be otherwise difficult or uneconomical to produce by prior known processes.

The process can be utilized in an oil reservoir at any stage of pressure depletion; but, is most uniquely applicable in oil reservoirs which are: (1) essentially depleted of primary energy, (2) reservoirs which have undergone successful secondary recovery processes (primarily water flooding), (3) reservoirs which have undergone unsuccessful secondary recovery efforts due to adverse rock or fluid properties which caused premature breakthrough of injected or "driving" fluid, (4) in primary depleted reservoirs which are not considered as candidates for secondary recovery processes, or (5) reservoirs which have undergone tertiary recovery processes which have left substantial volumes (or percentage saturation) of oil in-place.

12 Claims, 1 Drawing Figure

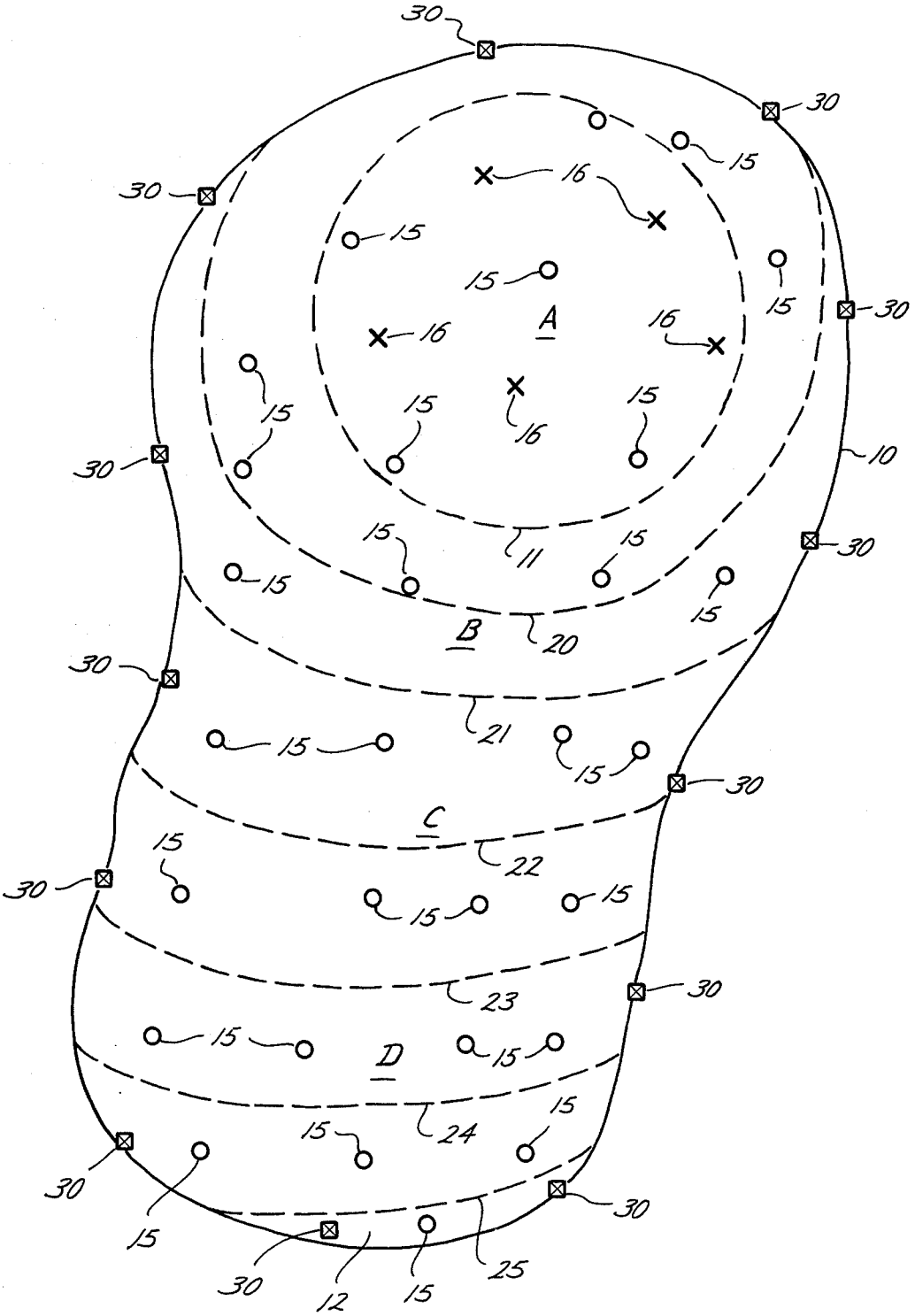
30
30
30
30
30
30
30
30
30
30
30
30
30
30
15
16
A
B
C
D
10
11
12
20
21
22
23
24
25

PROCESS FOR RECOVERY OF HYDROCARBONS

BACKGROUND OF THE INVENTION

The field of this invention is processes for the recovery of hydrocarbons from oil reservoirs.

Tremendous volumes of hydrocarbon liquids remain in-situ in a very large number of oil fields in the United States, even after successful primary, secondary and even tertiary recoveries from such oil fields or reservoirs.

Primary recovery from oil fields or reservoirs involves the conventional means of producing oil, which is either by its own natural well pressure which causes it to flow by itself, or by the use of pumping means at the surface for withdrawing the oil from the reservoir. When the pumping procedure becomes inefficient or impossible, then, in the past, secondary recovery methods have sometimes been employed.

Secondary recovery methods involve the injection of liquids, and also gases in some limited cases, into adjacent wells to the one which is to be produced, with the liquid raising the level of the oil and the bottom hole pressure sufficiently to enable the well to thereafter be produced by pumping so that some additional recovery of the oil can be accomplished. Various liquids are employed, including water, chemically altered water and other chemicals known in the art.

Tertiary recovery methods have also been employed, particularly after the secondary recovery methods have failed to place the well in condition for further recovery. The tertiary recovery methods have employed such means as steam injection, in-situ combustion, and the use of exotic fluid injection methods intended to improve recovery efficiency.

With even the highest recovery efficiency, following the primary and secondary recovery methods, significant amounts of hydrocarbon liquids still remain in oil reservoirs in the United States today, and it has been estimated by competent authorities that average amounts remaining in the wells constitutes almost twice as much oil as has been recovered to date.

Not only has a substantial amount of oil or other hydrocarbons thus been left in the ground in the oil or hydrocarbon reservoirs, but at the same time, another important hydrocarbon, natural gas, has been shipped by pipeline to various parts of the United States. The demand for such natural gas has increased tremendously so that an adequate supply of natural gas for the future appears to be in jeopardy. Further, it is well known that there are peak demands for natural gas, such as occur in the extremely cold winter weather. In the past, efforts have been made to provide underground storage in salt domes and the like for natural gas so that large quantities of gas would be readily available to supply peak demands.

The Applicant is aware of some prior patents which have attempted various techniques for the recovery of hydrocarbons and/or the storage of natural gas, and the differences are noted hereinafter. For example, U.S. Pat. No. 1,067,868 relates to a method of increasing the pressure in a well or reservoir by the use of natural gas injection. This patent was based upon the concept that the gas formed an upper layer in the well formation, similar to that shown in U.S. Pat. No. 3,500,914. In other words, as shown in U.S. Pat. No. 3,500,914, the gas is trapped in a pocket at the upper portion thereof and it was apparently the concept of the patentee in U.S. Pat. No. 1,067,868 that such oil could be forced upwardly by increasing the upper layer of gas. The present invention relates to a relatively flat monoclinal formation, wherein the gas under pressure mixes with the oil and, as will be more fully explained, the light ends of the oil or the liquid hydrocarbon in the well vaporize, and the gas becomes enriched with the liquid hydrocarbon. Also, to some extent the injected gas enters into its liquid phase and intimately mixes with the volume of oil in the reservoir. The well into which the gas is injected causes an increase in the bottom hole pressure of the oil or hydrocarbons in adjacent well or wells so that such well or wells are thereafter capable of being produced, or are produced by their own pressure so that additional oil is removed therefrom.

Examples of secondary and tertiary recovery are found in several prior patents known to the applicant such as U.S. Pat. No. 3,878,891.

U.S. Pat. No. 3,623,552 relates to the injection of a gas such as carbon dioxide, and contrary to the present invention, such patent suggests that methane, which is the primary constituent of pure natural gas which is used in the present invention, is a contaminant.

U.S. Pat. Nos. 2,724,437 and 2,724,438 relate to methods wherein production is obtained from wells that are producing, rather than depleted wells of the type treated with the present invention.

U.S. Pat. No. 3,411,577 relates to the secondary recovery in wells having a trap such as shown in the drawing of U.S. Pat. No. 3,500,914, as indicated by the suggestion in Column 2, line 17, of that patent that the injection of the gas is into the "thinner zone of a reservoir".

In defensive publication, T882013, the recovery of volatile liquid from underground storage is disclosed.

U.S. Pat. No. 2,875,831 relates to dissemination of wetting agents through the strata where the petroleum is located by means of carbonated water, which is a totally different concept from the present invention.

U.S. Pat. No. 2,856,000 discloses the concept of relatively lean high pressure gas increasing the pressure of a low pressure reservoir and also becoming enriched by taking up by retrograde condensation the normally liquid phase hydrocarbons present in the lower pressure condensate reservoir. However, the entire process is kept underground, with two reservoirs, a high pressure zone underlying a low pressure zone, contrary to the present invention, wherein the enriched gas is returned to the surface with the liquid hydrocarbons for the stripping of the gas and the recovery of the hydrocarbons.

U.S. Pat. No. 2,669,307 relates to a typical secondary recovery method wherein water is used to inject into a well for the recovery of oil from one or more other wells in a reservoir.

U.S. Pat. No. 3,123,134 relies upon the repeated pressuring and pressure reduction of gas injected into an oil well for the recovery of oil, which differs from the present invention, wherein the gas pressure is gradually increased over the life of the reservoir, during the reduction of the oil using the method of this invention, until the final native pressure of the reservoir is reached.

Additional patents of interest with respect to underground storage are U.S. Pat. Nos. 3,331,206; 3,807,181; and 3,277,654, all of which are simply related to the storage of gas and do not include the recycling of gas for the recovery of oil from formations, as in the present invention.

U.S. Pat. No. 3,878,891 should also be mentioned as a patent relating to the secondary injection and tertiary injection processes known in the art, utilizing liquids such as water for such production.

SUMMARY OF THE INVENTION

The present invention relates to a process for the recovery of hydrocarbons from oil field reservoirs wherein premium pipeline quality natural gas, normally used for consumption as a power source supply for boiler-fuel to generate electricity, fuel for other power source and for fuel in commercial, industrial, and domestic uses is used instead to produce liquid hydrocarbons (oil, condensate and plant products) of which the heavier ends (oil, condensate) can be used as a replacement fuel for the natural gas, thus preserving the latter for recycling process while still providing a fuel supply, plus other premium hydrocarbon liquids.

The process of this invention effects recovery of hydrocarbons in wells by four phenomena i.e. (1) enrichment of gas by liquid absorption or retrograde condensation, (2) liquid volume increase, or swelling by miscible mixing of liquified natural gas with the in-situ oil, (3) movement of oil from regime of high pressure (around the injection well) to a low pressure regime (around the producing well) and, (4) liquid recovery due to entrainment and movement of oil in a mist-phase during the "blow-down" recovery of the natural gas at final recovery time.

BRIEF DESCRIPTION OF THE DRAWINGS

The FIGURE of the drawing is a plan view schematically illustrating the location of an oil well reservoir or field wherein a plurality of gas injection wells are indicated, together with producing wells and also water injection wells, which are utilized in accordance with the method or process of this invention.

DESCRIPTION OF THE PREFERRED EMBODIMENT

Referring now to the drawing, which illustrates a typical underground oil reservoir or field, having a perimeter indicated by the numeral 10, completely surrounding the field which perimeter is caused by natural conditions in the ground such as sand or soil, rock, porosity, elevation faults or other similar conditions known to those familiar with oil field reservoirs. The present invention is suitable for reservoirs which are at a minimum of 2,000 feet below the earth's surface and preferably within the range of 2,000 to 5,000 feet in depth but the process is not limited to depths above 5,000 feet because the process is operable at any depth below the depth necessary to hold a pressure sufficient to create liquefication of natural gas. Typically, the reservoir will be monoclinal, but will have a portion at a lower elevation which is defined by dotted circle 11, and the reservoir will extend to a remote area therefrom at a higher elevation such as indicated by the numeral 12 in the drawings.

The reservoir having a perimeter 10 as shown in the drawing is one wherein some of the hydrocarbons have been previously produced therefrom, normally by both primary and secondary recovery methods. The producing wells indicated by solid dots 15 are wells which were previously drilled and have either been abandoned or have been so depleted that they are uneconomical for further production by prior known procedures.

Gas injection wells are indicated by the letter X in the drawing, and are further identified with the numeral 16.

In carrying out the method of this invention, dry natural gas suitable for flow through a pipeline, preferably but not limited to all or substantially all methane, is injected into one or more of the injection wells 16. Such injection well or wells may be those which have previously been used for the production of oil, or they may be newly drilled wells located in proximity to previously produced wells. In the initial stages of carrying out the process of the invention, for optimum initial liquid recovery, the gas is injected into the lowermost portion of the reservoir, indicated within the imaginary circle 11 of the complete reservoir bounded by the perimeter 10. However, the gas can be initially injected in the highest structure level of the reservoir. Ultimately, liquid recovery should be nearly equal regardless of the formation level at which the gas injection is initiated. The result of such gas injection over a period of time is to permit a storage of such gas in the reservoir, and to also increase the bottomhole pressure of the adjacent well or wells 15 so that oil can then be produced from such well or wells 15, either by pumping or by its own pressure.

In the course of the gas flowing into the injection well 16 and contacting the liquid hydrocarbon in the well, the light ends, such as ethane, propane and butane, of the liquid hydrocarbons are vaporized by retrograde condensation and enrich the gas itself so that when production of oil and gas occurs at the wells 15, for the ultimate recovery of the hydrocarbons at the surface some of the oil is recovered in the gas which is stripped of such light hydrocarbons which have enriched the gas. The stripping of the gas occurs at the surface by extraction of vaporized liquids in a conventional liquid extraction plant, so that the gas is returned to a dry condition, which is normally essentially pure methane for return or recycling in the injection wells 16, as will be more evident hereinafter.

Furthermore, the gas which is injected into the wells 16 liquefies to some extent and mixes with the oil in the well which causes a swelling of the liquid in the reservoir, resulting in a greater volume of liquid occupying the same space previously occupied by the oil alone, thus resulting in an increase in the bottom hole pressure in the well.

An important aspect of this invention is the recycling of the natural gas after it has been stripped, or stated differently, the liquid hydrocarbons have been removed therefrom, so that the natural gas is continuously utilized for further production of oil from the reservoir. Typically, the dry natural gas which is injected into the well or wells 16 has a heating capability of 960 to 1000 BTUs and when it is produced from the producing wells 15, it has a heating value of 1300 to 1400 BTUs. After stripping at the surface, the gas is returned to the original heating value, which means that the additional heating value was due to the recovered oil and other hydrocarbon liquids which then may be utilized for fuel or for other known purposes. Thus, oil is available which would not otherwise be available, and at the same time, the natural gas has not been wasted or expended. Instead, it is recycled back into the formation and is reutilized for a continuing of such process.

The method of this invention thus continues in the manner described, with repeated recycling of the natural gas and recovering oil from the various producing wells 15, in successive stages going from the imaginary area as defined by the circle 11 to the next imaginary area defined by the circle 20 and continuing on to the next area defined by the line 21 then the line 22, line 23, line 24, and line 25. The pressure of the natural gas which is introduced is in excess of the pressure in the well. Also, it should be noted that the oil is moved in a mass transfer or displacement from the lowermost elevation of the reservoir area to the successively higher elevations within each of the areas 20, 21, 22, 23, 24 and 25.

While such mass transfer of the oil is occurring, the gas is repeatedly recycled; additional gas is also injected into the well from other sources so that the oil which is removed by this process is replaced by gas that is injected through the injection wells 16. Typically, the gas may be recycled fifteen or twenty times before reaching the point of substantially filling the reservoir with gas and having removed virtually all of the oil from the reservoir.

In the final stages of the liquid recovery process, to recover the maximum amount of the liquid hydrocarbons from the reservoir, water is injected under pressure to strategically located wells around the periphery of the field, such as indicated by the squares 30. The water injection may be accomplished as in prior secondary recovery procedures, but it is to be noted that in this case, such water injection works in conjunction with the gas injection so that the water injection serves to force the oil or gas from the perimeter of the reservoir to one or more of the wells 15 or 16. Finally, the gas itself may be recovered by such injection of water or other liquid into the water injection wells 30 so that the gas can be recovered and utilized for either fuel or for further processing in other reservoirs using the method of this invention.

It is known that wells which have been produced by the normal secondary recovery processes used in the prior art generally have from forty to sixty percent of the oil still remaining in place in the reservoir, while wells which have been treated by some tertiary methods may have as much as thirty to forty percent of the oil still in the reservoir, with the obvious exception of those reservoirs in which in-situ combustion has taken place.

The process of this invention effects recovery of hydrocarbons in wells by four phenomena i.e. (1) enrichment of gas by liquid absorption or retrograde condensation, (2) liquid volume increase, or swelling by miscible mixing of liquified natural gas with the in-situ oil, (3) movement of oil from regime of high pressure (around the injection well) to a low pressure regime (around the producing well) and, (4) liquid recovery due to entrainment and movement of oil in a mist-phase during the "blow-down" recovery of the natural gas at final recovery time.

When the process is initiated in a "watered-out" oil reservoir which has undergone a secondary recovery process the bottom-hole pressure is in the range of 70–80% of original pressure; consequently the first three above-listed phenomena commence at an early, efficient rate; whereas, in a depleted reservoir considerable gas volumes must be injected before the reservoir pressure is increased to a level for retrograde condensation and oil swelling to commence operating efficiently.

It should be observed that by carrying out the present invention, not only has oil been recovered from reservoirs which would not otherwise be recovered by known processes, but in addition, the natural gas is saved for future use because the additional oil which is produced can be used as fuel instead of using the relatively scarce natural gas. If desired, some of the natural gas can be utilized during peak demands rather than recycling all of it, because it is available in the reservoir for such peak demands. However, the method of this invention is preferably carried out by the gradual increasing of the pressure in the reservoir for the full recovery of all or at least most of the liquid hydrocarbon remaining in the reservoir prior to carrying out this method. Such process therefore accomplishes the maximum energy saving of the natural resources available, while also providing a storage area for the natural gas which has been produced and which otherwise would have to be stored in salt domes or similar places which require additional investment and problems of location and storage.

Although the invention has been illustrated with respect to a reservoir having a particular configuration, it is to be understood that the invention is not limited to such a reservoir, since such illustrated reservoir is merely exemplary.

Various changes and modifications may be made in the process as disclosed herein, within the scope of this invention as more particularly defined in the appended claims.

I claim:

1. A process for the recovery of hydrocarbons from a partially depleted oil formation reservoir that has been subjected to at least primary recovery operations while the reservoir serves as a storage facility for natural gas, comprising the steps of:

injecting dry natural gas into one well of an oil-bearing reservoir having a plurality of wells previously drilled therein, wherein the production of oil from said wells was theretofore discontinued;

continuing said injecting until the bottom-hole pressure of an adjacent well is increased sufficiently to enable production of oil therefrom to be effected and enriching said gas by vaporization of the light ends of the oil in the reservoir;

producing oil and some enriched gas from the adjacent well;

separating oil and other hydrocarbon liquids from the natural gas to provide a stripped natural gas which is essentially entirely methane;

recycling the stripped dry natural gas back into the formation a plurality of times to repeat the foregoing steps for maximum recovery of the oil from the reservoir while storing the natural gas for subsequent use; and diverting during peak demands the stripped dry natural gas to satisfy such peak demands of natural gas wherein said reservoir serves as a storage reservoir while recovering additional hydrocarbons from the reservoir by recycling the natural gas.

2. The process set forth in claim 1, including:

continuing to inject dry natural gas in addition to the recycled natural gas for gradually increasing the bottom hole pressure in one or more wells beyond said adjacent well and for effecting a mass transfer of oil to the lower pressure region of the reservoir to enable production of oil therefrom to also be effected.

3. The process set forth in claim 2, including:

continuing to produce oil from said reservoir until the reservoir nears the stage of being almost entirely filled with the natural gas; and then injecting pressurized water or the like into wells at the periphery of the reservoir to push the remaining oil back into the reservoir area for production.

4. The process set forth in claim 3, including:

finally producing the gas in the reservoir and transporting it for use as a fuel or for recovery of more oil at other depleted hydrocarbon reservoirs.

5. The process set forth in claim 3, wherein:

oil from the reservoir has been produced but at least about thirty percent of the original oil in the reservoir remains prior to carrying out this process; and at least half of said oil remaining in place is produced by this process.

6. The process set forth in claim 5, wherein:

the wells in the reservoir had been previously treated by secondary or tertiary recovery processes.

7. The process set forth in claim 1, wherein:

the reservoir is at a depth in excess of about two thousand feet.

8. The process set forth in claim 1, including:

transporting a portion of the stripped natural gas for use as fuel in periods of peak demand.

9. A process for the recovery of hydrocarbons from a partially depleted oil formation reservoir that has been subjected to at least primary recovery operations and which reservoir is unsuited for other secondary recovery processes due to adverse properties of the formation while the reservoir also serves as a storage facility for natural gas, comprising the steps of:

injecting dry natural gas into one well of an oil-bearing reservoir having a plurality of wells previously drilled therein, wherein the production of oil from said wells was theretofore discontinued;

continuing said injecting until the bottom-hole pressure of an adjacent well is increased sufficiently to enable production of oil therefrom to be effected and enriching said gas by vaporization of the light ends of the oil in the reservoir;

producing oil and some enriched gas from the adjacent well in the formation;

separating oil and other hydrocarbon liquids from the natural gas to provide a stripped natural gas which is essentially entirely methane;

recycling the stripped dry natural gas back into the formation a plurality of times to repeat the foregoing steps for maximum recovery of the oil from the reservoir while storing the natural gas for subsequent use; and diverting during peak demands the stripped dry natural gas to satisfy such peak demands of natural gas wherein said reservoir serves as a storage reservoir while recovering additional hydrocarbons from the reservoir by repeatedly recycling the natural gas.

10. A process for the recovery of hydrocarbons from a partially depleted oil formation reservoir that has been subjected to at least primary recovery operations and which reservoir is unsuited for other secondary recovery processes due to adverse properties of the formation, comprising the steps of:

injecting dry natural gas into one well of an oil-bearing reservoir having a plurality of wells previously drilled therein, wherein the production of oil from said wells was theretofore discontinued;

continuing said injecting until the bottom-hole pressure of an adjacent well is increased sufficiently to enable production of oil therefrom to be effected by enriching said gas by vaporization of the light ends of the oil in the reservoir;

producing oil and some enriched gas from the adjacent well in the formation;

separating oil and other hydrocarbon liquids from the natural gas to provide a stripped natural gas which is essentially entirely methane; and recycling the stripped dry natural gas back into the formation a plurality of times to repeat the foregoing steps for maximum recovery of the oil from the reservoir while storing the natural gas for subsequent use.

11. A process for the recovery of hydrocarbons from a partially depleted oil formation reservoir that has been subjected to water flooding secondary recovery operations while the reservoir also serves as a storage facility for natural gas, comprising the steps of:

injecting dry natural gas into one well of an oil-bearing reservoir having a plurality of wells previously drilled therein, wherein the production of oil from said wells was theretofore discontinued;

continuing said injecting until the bottom-hole pressure of an adjacent well is increased sufficiently to enable production of oil therefrom to be effected and enriching said gas by vaporization of the light ends of the oil in the reservoir;

producing oil and some enriched gas from the adjacent well in the formation;

separating oil and other hydrocarbon liquids from the natural gas to provide a stripped natural gas which is essentially entirely methane;

recycling the stripped dry natural gas back into the formation a plurality of times to repeat the foregoing steps for maximum recovery of the oil from the reservoir while storing the natural gas for subsequent use; and diverting during peak demands the stripped dry natural gas to satisfy such peak demands of natural gas wherein said reservoir serves as a storage reservoir while recovering additional hydrocarbons from the reservoir by recycling the natural gas.

12. A process for the recovery of hydrocarbons from a partially depleted oil formation reservoir that has been subjected to water flooding secondary recovery operations while the reservoir also serves as a storage facility for natural gas, comprising the steps of:

injecting dry natural gas ito one well of an oil-bearing reservoir having a plurality of wells previously drilled therein, wherein the production of oil from said wells was theretofore discontinued;

continuing said injecting until the bottom-hole pressure of an adjacent well is increased sufficiently to enable production of oil therefrom to be effected and enriching said gas by vaporization of the light ends of the oil in the reservoir;

producing oil and some enriched gas from the adjacent well in the formation;

separating oil and other hydrocarbon liquids from the natural gas to provide a stripped natural gas which is essentially entirely methane; and recycling the stripped dry natural gas back into the formation a plurality of times to repeat the foregoing steps for maximum recovery of the oil from the reservoir while storing the natural gas for subsequent use.

* * * * *